US005462611A

United States Patent [19]

Uematsu et al.

[11] Patent Number: 5,462,611

[45] Date of Patent: Oct. 31, 1995

[54] FERRITIC STAINLESS STEEL EXCELLENT IN HIGH TEMPERATURE OXIDATION RESISTANCE AND SCALE ADHESION

[75] Inventors: Yoshihiro Uematsu, Kudamatsu; Naoto Hiramatsu; Manabu Oku, both of Tokuyama, all of Japan

[73] Assignee: Nisshin Steel Co., Ltd., Tokyo, Japan

[21] Appl. No.: 356,248

[22] PCT Filed: Apr. 26, 1994

[86] PCT No.: PCT/JP94/00693

§ 371 Date: Dec. 22, 1994

§ 102(e) Date: Dec. 22, 1994

[87] PCT Pub. No.: WO94/25636

PCT Pub. Date: Nov. 10, 1994

[30] Foreign Application Priority Data

Apr. 27, 1993 [JP] Japan ..... 5-122112
Apr. 27, 1993 [JP] Japan ..... 5-122162

[51] Int. Cl.[6] ..... C22C 38/20

[52] U.S. Cl. ..... 148/325; 420/60

[58] Field of Search ..... 420/60, 70; 148/325

[56] References Cited

U.S. PATENT DOCUMENTS 4,417,921 11/1983 Maurer .
4,461,811 7/1984 Borneman et al. .
4,640,722 2/1987 Gorman .

FOREIGN PATENT DOCUMENTS 57-2267 1/1982 Japan .
59-15976 4/1984 Japan .
60-145359 7/1985 Japan .
62-112757 5/1987 Japan .
1-159355 6/1989 Japan .

*Primary Examiner*—Deborah Yee
*Attorney, Agent, or Firm*—Lowe, Price, LeBlanc & Becker

[57] ABSTRACT

A ferritic stainless steel excellent in high temperature oxidation resistance and scale adhesion which consists essentially of in mass %, 0.03% maximum C, from 0.80% to 1.20% Si, from 0.60% to 1.50% Mn, from 11.0% to 15.5% Cr, from 0.20% to 0.80% Nb, 0.1% maximum Ti (inclusive of non-addition), not less than 0.02% and less than 0.30% Cu, 0.03% maximum N, 0.05% maximum Al (inclusive of non-addition), 0.012% maximum O, the balance being Fe and unavoidable impurities, and wherein the Mn/Si ratio is within the range between 0.7 and 1.5 and the alloying elements are adjusted so that the following relations (1), (2), and (3) and preferably (4) defined herein may be satisfied and wherein the steel exhibits an oxidation weight gain of not more than 0.02 kg/m$^2$ and an amount of scale which has spalled of not more than 0.01 kg/m$^2$ after a continuous heating in atmospheric air at 900° C. for 100 hours and the steel exhibits an oxidation weight gain of not more than 0.4 kg/m$^2$ and an amount of scale which has spalled of not more than 0.02 kg/m$^2$ after a continuous heating in atmospheric air at 1000° C. for 100 hours.

6 Claims, 5 Drawing Sheets

FERRITIC STAINLESS STEEL EXCELLENT IN HIGH TEMPERATURE OXIDATION RESISTANCE AND SCALE ADHESION

FIELD OF APPLICATION IN INDUSTRY

The invention relates to a ferritic stainless steel excellent in high temperature oxidation resistance and scale adhesion suitable for use in the manufacture of exhaust gas tubular members in exhaust gas systems connected to various internal-combustion engines, in particular, in the manufacture of automotive exhaust gas manifolds.

BACKGROUND OF THE INVENTION

Because of recent growing concern on environmental pollution problems, there are eagerly desired thermal power generation systems or engines which can exhibit high combustion efficiency and automotive engines which can clear recent severe regulations on exhaust gases. Measures taken for these purposes result in an combustion gas having a higher temperature and, in consequence, adjacent members, e.g. a system for purifying an exhaust gas, connected to the thermal power generation engines or automotive engines are necessarily encountered to the higher temperature. Accordingly, further enhanced heat resistance is required for them. For heat resistance of a material, high temperature oxidation resistance, that is a property of the material that it is well durable under an atmosphere of a high temperature gas, is required, in addition to high temperature strength of the material.

In order that a material is excellent in high temperature oxidation resistance for a purpose of the invention, it is desirable that the material does not undergo abnormal oxidation and exhibits the smallest possible oxidation weight gain during its service. Besides, the material should be excellent in adhesion of oxide scale (oxide film). Since operation of internal-combustion engines such as automobile engines includes repeated starting and stopping of driving and thermal power generation systems are operated in daily start and stop (DSS) fashion, heat-resisting members connected to such engines of systems are subjected to repeated cycles of heating and cooling. Accordingly, with materials poor in adhesion of oxide film, it spalls posing problems of clogging of piping and reduction in thickness of the heat-resisting members themselves which might lead to mechanical breakage of the members.

Austenitic stainless steels have better high temperature strength than ferritic stainless steels. However, because of their larger thermal expansion and in turn larger thermal strain, when compared with ferritic stainless steels, austenitic stainless steels are liable to cause cracking due to thermal fatigue when subjected to repeated cycles of heating and cooling. Moreover, because of their large difference between thermal expansion of the base metal and that of oxide scale, austenitic stainless steels exhibit an increased amount of scale spalling.

For these reasons ferritic stainless steels have been used in the manufacture of automobile exhaust gas systems. For example, a ferritic stainless steel, SUS430JIL has been used in the manufacture of an automobile exhaust manifold. This steel, however, poses problems of an increased amount of scale spalling and of an expensive cost of the material.

U.S. Pat. No. 4,640,722 discloses and claims a ferritic stainless steel exhibiting improved cyclic oxidation resistance and creep strength, after a final anneal at 1010° to 1120° C., which develops Nb-Si rich Laves phases, suitable for use in the manufacture of automobile exhaust gas systems, consisting essentially of, in weight percent, $C \leqq 0.05\%$, $Mn \leqq 2\%$, $1.0\% < Si \leqq 2.25\%$, $Al < 0.5\%$, $3 \times Al \leqq Si$, $6\% \leqq Cr \leqq 25\%$, $Mo \leqq 5\%$, $8\% \leqq Mo+Cr$, $N \leqq 0.05\%$ $4 \times C+3.5 \times N \leqq$ at least one of Ti, Zr and $Ta \leqq 0.5\%$, total $Nb \leqq 0.3\%$, $0.1\% \leqq$ uncombined Nb, and balance essentially Fe. However, this U.S. Patent does not teach how to suppress oxide film spalling nor address to low temperature toughness and fabricability of the steel. For use in the manufacture of automobile exhaust manifold, the steel is required to have improved adhesion of oxide film and low temperature toughness in addition to improved cyclic oxidation resistance.

U.S. Pat. No. 4,461,811 discloses and claims a stabilized ferritic stainless steel consisting essentially of, in weight percent, $C \leqq 0.03\%$, $N \leqq 0{,}05\%$, $10.5\% \leqq Cr \leqq 13.5\%$, $Al \leqq 0.10\%$, $Ti \leqq 0.12\%$, $Al+Ti \leqq 0.12\%$, the sum of Ti and at least one of Nb and Ta in an amount sufficient to stabilize C and N, balance essentially Fe and impurities. It is taught that the stabilized steel is wettable by a brazing filler such as Cu and Ni and thus suitable for use in the manufacture of brazed parts which are composed in heat exchangers and exhaust gas systems requiring oxidation and corrosion resistances at elevated temperatures inherent to ferritic stainless steels. However, it is not clear whether improved adhesion of oxide film, low temperature toughness and fabricability are concurrently possessed or not by the stabilized steel according to the '811 patent. No measure to achieve these improved properties is not suggested nor recognized.

U.S. Pat. No. 4,417,921 discloses a ferritic stainless steel consisting essentially of, in weight percent, $C \leqq 0.03\%$, $N \leqq 0.03\%$, $C+N \leqq 0.04\%$, $11.5\% \leqq Cr \leqq 13.5\%$, $Mn \leqq 1.0\%$, $Si \leqq 1.0\%$, $Ni \leqq 0.5\%$, $Cu \leqq 0.15\%$, $Ni+3 \times Cu \leqq 0.80\%$, at least one of Ti and Nb in an amount from 0.1% and $4 \times (C + N)$ up to 0.75% balance essentially Fe and usual steelmaking residuals. It is said that this steel is suitable for integrally-finned tubing of heat exchangers because of its excellent weldability, ductility, fabricability and resistance to stress corrosion cracking. The '921 patent, however, does not teach effects of alloying elements on high temperature properties of ferritic stainless steels, particularly on high temperature oxidation resistance and adhesion of oxide film. It does not address to properties required for automobile exhaust gas manifolds.

For use in exhaust gas systems, particularly automobile exhaust gas manifolds, eagerly desired are inexpensive ferritic stainless steels which have high temperature strength well comparable to SUS430JIL and which are excellent in high temperature properties including high temperature oxidation resistance and adhesion of oxide film and which are excellent in low temperature toughness and fabricability. This desire is growing in view of recent progress in combustion efficiency of internal engines and improvement in exhaust gas purification. An object of the invention is to provide a ferritic stainless steel satisfying the above-mentioned desire in the art.

SUMMARY OF THE INVENTION

According to the invention there is provided a ferritic stainless steel excellent in high temperature oxidation resistance and scale adhesion which consists essentially of in mass %, C: up to 0.03%, Si: from 0.80% to 1.20%, Mn: from 0.60% to 1.50%, Cr: from 11.0% to 15.5%, Nb:b from 0.20% to 0 0.80%, Ti: up to 0.1% (inclusive of non-addition), Cu: not less than 0.02% and less than 0.30%, N:

up to 0.03%, Al: up to 0.05% (inclusive of non-addition); O: up to 0.012%, the balance being Fe and unavoidable impurities, and wherein the alloying elements are adjusted so that the following relations (1), (2), and (3):

$$0.7 \leqq Mn/Si \leqq 1.5, \quad (1)$$

$$1.4 \leqq Nb + 1.2Si \leqq 2.0 \text{ and} \quad (2)$$

$$1221.6(C + N) - 55.1Si + 65{,}7Mn - 8.7Cr - 99.5Ti - 40.4Nb + 1.1Cu + 54 \leqq 0 \quad (3)$$

are concurrently satisfied, and wherein said steel exhibits an oxidation weight gain of not more than 0.02 kg/m$^2$ and an amount of scale which has spalled of not more than 0.01 kg/m$^2$ after subjected to a continuous heating in atmospheric air at a temperature of 900° C. for a period of 100 hours and said steel exhibits an oxidation weight gain of not more than 0.4 kg/m$^2$ and an amount of scale which has spalled scale of not more than 0.02 kg/m$^2$ after subjected to a continuous heating in atmospheric air at a temperature of 1000° C. for a period of 100 hours.

The invention further provides a ferritic stainless steel excellent in high temperature oxidation resistance and scale adhesion which consists essentially of in mass %, C: up to 0.03%, Si: from 0.80% to 1.20%, Mn: from 0.60% to 1.50%, Cr: more than 13.5% and not more than 15.5%, Nb: from 0.20% to 0.80%, Ti: up to 0.1% (inclusive of non-addition). Cu: not less than 0.02% and less than 0.30%, N: up to 0.03%, Al: up to 0.05% (inclusive of non-addition), O: up to 0.012%, the balance being Fe and unavoidable impurities, and wherein the alloying elements are adjusted so that the following relations (1), (2), (3) and (4):

| | |
|---|---|
| $0.7 \leqq Mn/Si \leqq 1.5$ | (1), |
| $1.4 \leqq Nb + 1.2\,Si \leqq 2.0$ | (2), |
| $1221.6(C + N) - 55.1\,Si + 65{,}7\,Mn - 8.7\,Cr - 99.5\,Ti - 40.4\,Nb + 1.1\,Cu + 54 \leqq 0$ | (3) and |
| $Cr + Mn + Si \geqq 14.7$ | (4) |

are concurrently satisfied, and wherein said steel exhibits an oxidation weight gain of not more than 0.2 kg/m$^2$ and an amount of scale which has spalled of not more than 0.01 kg/m$^2$ after subjected to a continuous heating in atmospheric air at a temperature of 930° C. for a period of 200 hours.

The invention still further provides the ferritic stainless steel defined in the preceding paragraph wherein the relation: $Cr+Mn+Si \geqq 15.5$ - - - (4') is satisfied and the steel exhibits an oxidation weight gain of not more than 0.2 kg/m$^2$ and an amount of scale which has spalled of not more than 0.01 kg/m$^2$ after subjected to a continuous heating in atmospheric air at a temperature of 950° C. for a period of 200 hours.

DETAILED DESCRIPTION OF THE INVENTION

As described in JP-B-59-15976, it is well known in the art that ferritic stainless steels exhibit good high temperature oxidation properties (reduced oxidation weight gain and enhanced adhesion of scale) by addition of rare earth metals (REM). As described in JP-B-57-2267, it is also known in the art that oxidation resistance, fabricability and weldability of ferritic stainless steels can be improved by reduction in amounts of C, N and Mn and by increase in an amount of Si. It is further known in the art as described in U.S. Pat. No. 4,640,722 and JP-A-60-145359 that oxidation resistance of Al containing ferritic stainless steels may be retained by substitution of Si for the Al which is effective for the oxidation resistance. We have now found that high temperature oxidation properties (reduced oxidation weight gain and enhanced adhesion of scale) of ferritic stainless steels can be improved by a measure completely different from those taken in the above discussed prior art. A new measure taken by us is to mutually adjust the Mn content and the Si content strictly within a certain range prescribed herein.

As a result of extensive research work about inexpensive 13Cr ferritic stainless steels looking for alloying elements which simultaneously achieve to suppress abnormal oxidation and to enhance adhesion of oxide film, we have found that addition of Si is effective to suppress abnormal oxidation; although Si effectively serves to suppress abnormal oxidation and in turn to reduce oxidation weight gain, oxide formed is liable to spall in the course of being cooled as is the case with SUS430JIL; conjoint addition of an appropriate amount of Mn greatly improves adhesion of oxide film (this information is contrary to the prior art prejudice to the effect that Mn adversely affects oxidation of high Cr ferritic stainless steels at high temperatures); and addition of an unduly excessive amount of Mn causes to form austenite which impairs high temperature oxidation resistance of the steel and where the steel might start to undergo abnormal oxidation.

Figure 1:
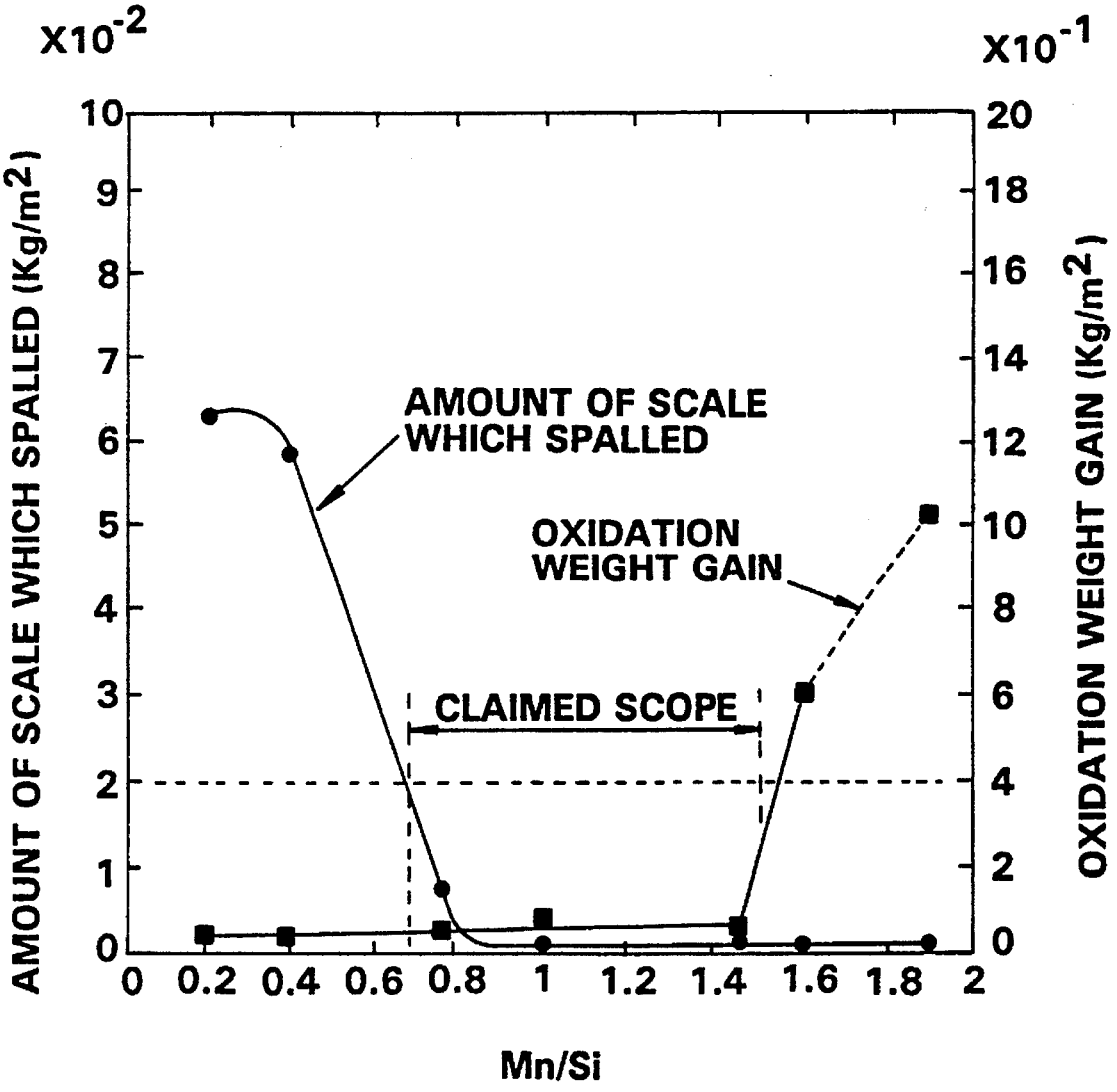
FIG. 1 is a graphical showing of an effect of the Mn/Si ratio in the steel on the high temperature oxidation resistance and on the adhesion of scale at a temperature of 1000° C., which has been revealed by the test hereinafter described.

FIG. 1 depicts, on ferritic stainless steels having a composition prescribed herein except for varied Mn/Si ratios, the oxidation weight gain and the amount of scale which has spalled after subjected to a continuous heating test, described hereinafter in detail, at 1000° C. for 100 hours, plotted against the Mn/Si ratio. It is understood from FIG. 1 that in cases wherein the Mn/Si ratio is within the range between 0.7 and 1.5 both the oxidation weight gain and the amount of scale which has spalled are minimized. As this ratio decreases less than 0.7 the amount of scale which has spalled drastically increases, while as this ratio increases larger than 1.5 the oxidation weight gain drastically increases.

While an operation mechanism of this is not yet exactly understood, we consider as follows. As the Si content of the steel increases the high temperature oxidation resistance of the steel is enhanced. This is believed because oxides primarily composed of $Cr_2O_3$ would be formed on the surface of the steel. However, mere increase of Si invites scale spalling. This is believed due to a difference between thermal expansion coefficients of the oxides primarily composed of $Cr_2O_3$ and the underlying base steel.

However, if Mn is coexist in such an amount that the Mn/Si ratio becomes not less than 0.7, Mn-containing spinel type oxides having a thermal expansion coefficient intermediate between those of the oxides primarily composed of $Cr_2O_3$ and the base metal would be formed together with the oxides primarily composed of $Cr_2O_3$. As a result-of the increase of Mn, while the oxidation weight gain will increase, the adhesion of the oxide formed would become better since the difference between thermal expansion coefficients of the oxides formed and the base metal would be reduced. On the other hand, with a steel containing such an amount of Mn that the Mn/Si ratio is in excess of 1.5, although the adhesion of oxide scale would be better, the steel would be liable to undergo abnormal oxidation posing a problem regarding heat resistance. Thus, with the ferritic stainless steels concerned, excellent high temperature oxidation properties including controlled oxidation weight gain and improved adhesion of scale could be achieved by strictly adjusting the Mn/Si ratio within the range between 0.7 and 1.5.

In other words, in order to form an increased amount of Mn-containing oxides thereby to improve adhesion of scale of a steel containing a relatively increased amount of Si, it is necessary to increase the Mn content in accordance with the Si content of the steel. Whereas in a case of a steel containing a relatively decreased amount of Si, it is necessary to decrease the Mn content in accordance with the Si content of the steel. With the steel containing a relatively decreased amount of Si, if the Mn content is insufficient, the steel is likely to form a γ-phase where abnormal oxidation might start on one hand and an increased amount of Mn-containing spinel type oxides leading to abnormal oxidation of the steel is formed on the other hand. Accordingly, an appropriate amount of Si must be ensured.

On each alloying element of the steel according to the invention its function and reasons for its amount in mass % to be contained will now be described.

C and N: On one hand C and N are generally important alloying elements for enhancing high temperature strength of the steel. On the other hand excessively high contents of C and N adversely affect oxidation resistance, fabricability and toughness of the steel, Furthermore, C and N combine with Nb in a ferritic phase of the steel thereby reducing an effective amount of Nb which serves to enhance high temperature strength of the steel. For these reasons each of C an N should be controlled not more than 0.03%.

Si: As discussed hereinabove, Si is an element indispensable for improving high temperature oxidation resistance of the steel. However, since an excessive amount of Si renders the steel hard thereby adversely affecting fabricability and toughness of the steel, Si should be controlled within the range between 0.8% and 1.2%. The optimum Si content is about 1.0%.

Mn: Mn is also an important element for the steel according to the invention. While oxidation weight gain of the steel can be reduced by addition of Si, oxide film formed when the steel is heated, is likely to spall when the heated steel is cooled. When a Mn added steel is heated the formed oxide film contains Mn-containing spinel type oxides, as described hereinabove, which remarkably improve adhesion of the oxide film. However, an excessive amount of Mn is likely to precipitate an austenitic phase which might induce abnormal oxidation of the steel. For these reasons Mn should be controlled within the range between 0.6% and 1.50%. The optimum Mn content is about 1.0%.

Cr: Cr is very effective for high temperature oxidation resistance of the steel and is required at least 11%. However, an excessively high amount of Cr not only renders the steel brittle and hard thereby adversely affecting fabricability of the steel but also makes the steel expensive. Accordingly, Cr should be controlled within the range between 11.0% and 15.5%, and preferably more than 13.5% and not more than 15.5%. In an application for automobile exhaust gas manifolds the steel is required to exhibit oxidation weight gain not more than 0.2 $kg/m^2$ and amount of scale which has spalled of not more than 0.01 $kg/m^2$ after the steel has been subjected to a continuous heating in air at a temperature of 950° C. for a period of 200 hours. For this requirement the total content Si+Mn+ Cr is desirably at least 15.5%. In this case, letting Mn/Si about 1, each of Si and Mn about 1% Cr should necessarily be more than 13.5%. The optimum Cr content is about 14.0%.

Nb: Nb is an important element for the steel according to the invention, since it effectively serves to maintain high temperature strength of the steel. To maintain high temperature strength of the steel, at least 0.20% of Nb is required. On the other hand, an excessive amount of Nb renders the steel susceptible to welding high temperature cracking. We set the upper limit for Nb as 0.80% so that sufficient high temperature strength of the steel may be maintained and welding high temperature cracking susceptibility may not be adversely affected. A preferred Nb content is within the range between 8×(C+N) and 0.60% in cases wherein each of C and N is the lowest possible value not more than 0.015%. The optimum Nb content is about 0.50%.

Cu: Cu serves to very effectively enhance both low temperature toughness and fabricability of the steel according to the invention. This will now be demonstrated by test results.

Figure 2:
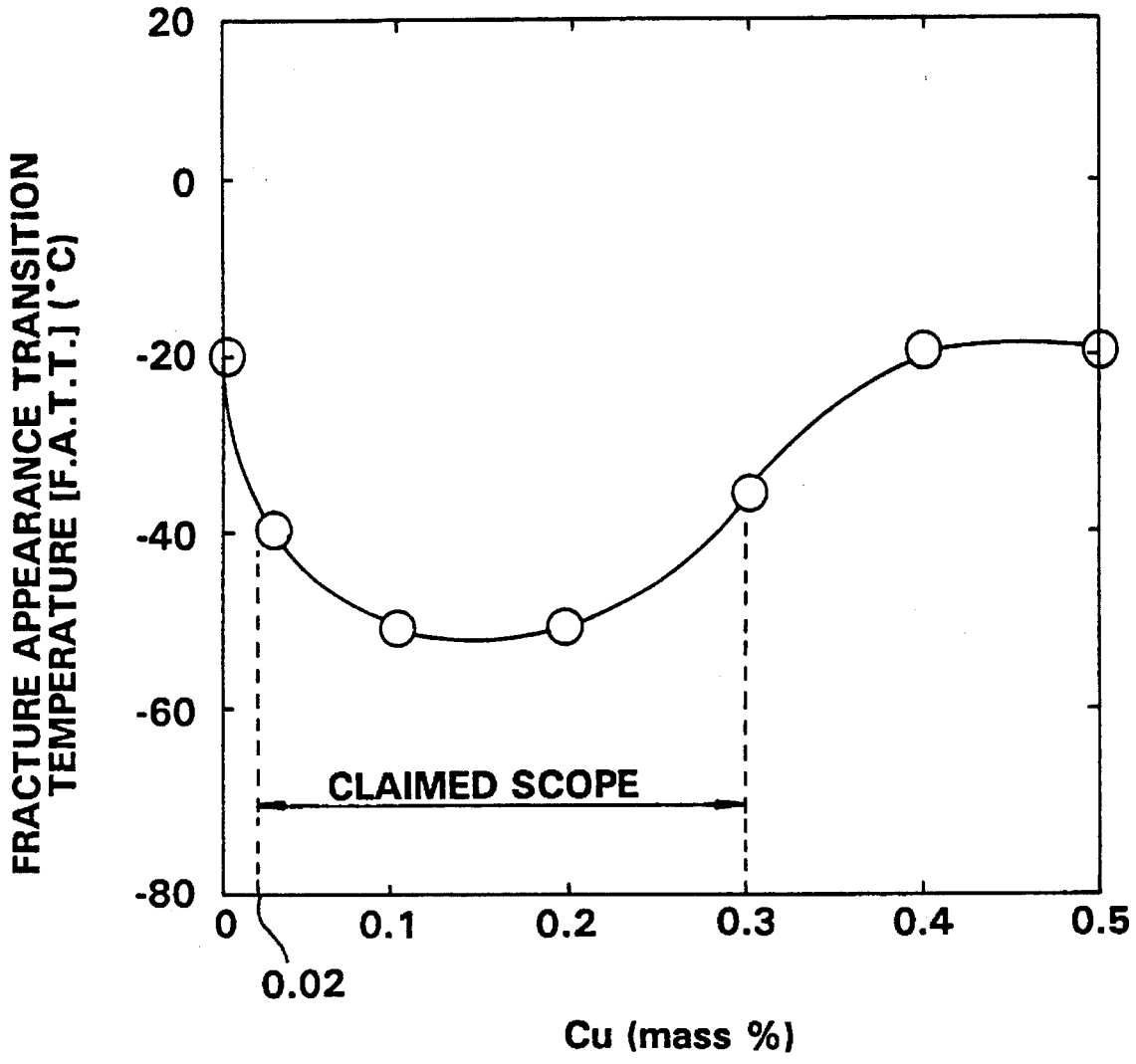
FIG. 2 is a graphical showing of an effect of the Cu content in the steel on the fracture transition temperature of the steel which has been revealed by the test hereinafter described.

In one test, an effect of the Cu content on fracture appearance transition temperature was examined about ferritic stainless steels having a basic composition of 14% Cr, 1.0% Si, 1.0% Mn, 0.5% Nb with varied Cu content. Results are shown in FIG. 2. In the test V-notched Charpy impact test pieces having a thickness of 2 mm of each steel to be tested were subjected to the impact test at various temperatures within the range between −75° C. and 50° C. and the lowest temperature at which 50% of the test pieces underwent ductile fracture was determined and is referred to herein as the fracture appearance transition temperature of point of the tested steel. The fracture appearance transition temperature which is a measure of low temperature toughness of the steel should preferably be not higher than −30° C. It is revealed from FIG. 2 that the tested steel has a fracture appearance transition temperature of not higher than −30° C. when the Cu content is not less than 0.02% and less than 0.30%. It is further revealed that as the Cu content reaches and exceeds 0.30%, while the steel still exhibits better toughness than that of the steel having no Cu added, the fracture appearance transition temperature of the steel tends to rise.

Figure 3:
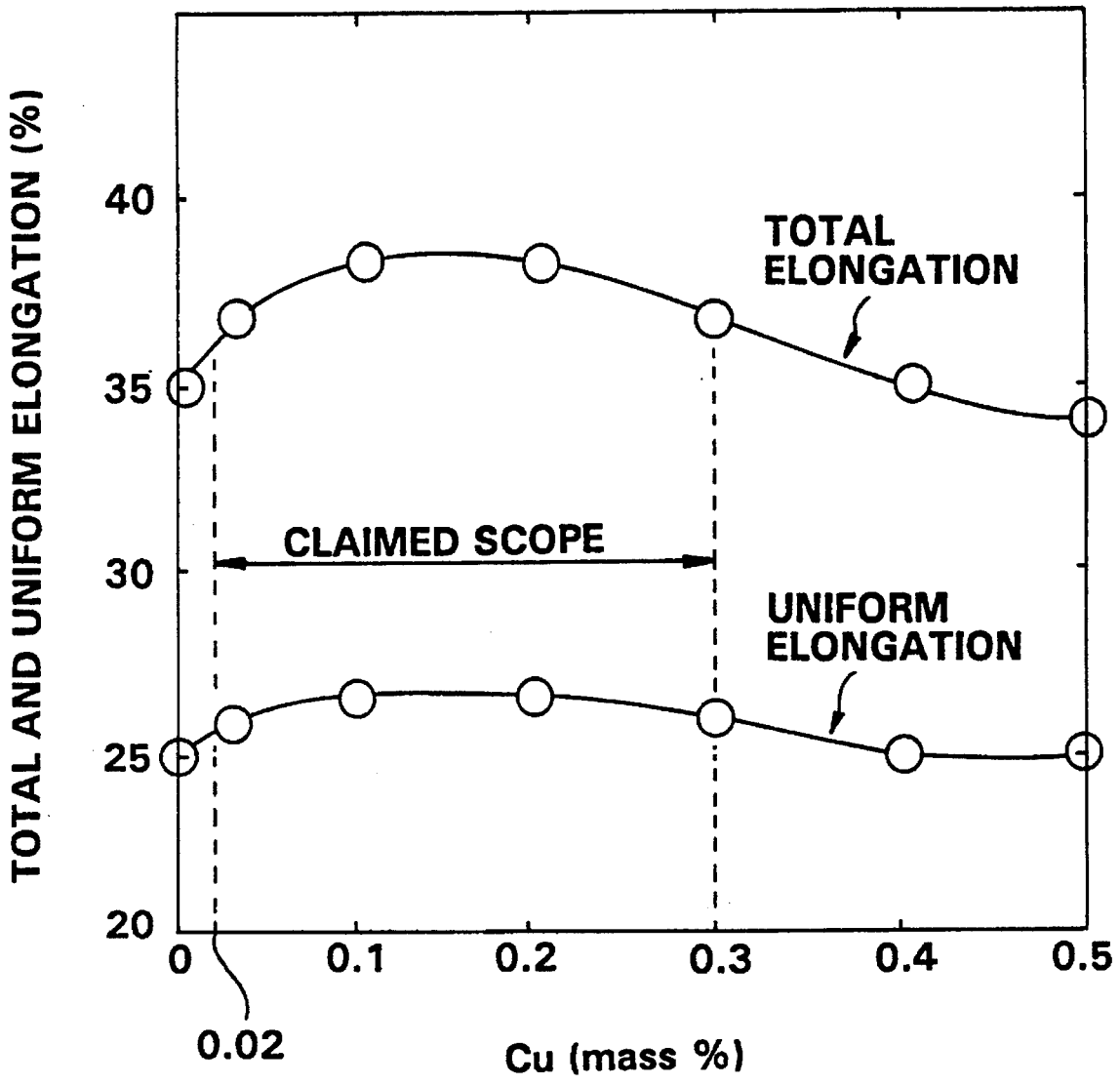
FIG. 3 is a graphical showing of an effect of the Cu content in the steel on the total and uniform elongation of the steel which has been revealed by the test hereinafter described.

About the same ferritic stainless steels having a basic composition of 14% Cr, 1.0% Si, 1.0% Mn, 0.5% Nb with varied Cu content as mentioned above, an effect of the Cu content on total elongation and uniform elongation was examined. Results are shown in FIG. 3. A test piece of a cold rolled and annealed sheet having a thickness of 2 mm of each steel to be tested was subjected to a tensile test in which the test piece was elongated along an L direction (a direction parallel to the rolling direction) at a rate of strain of 3 mm/min. whereby the total elongation and uniform elongation were determined. It is revealed from FIG. 3 that the total elongation and the uniform elongation of the tested steel are enhanced by controlling the Cu content within the range of from 0.02% and less than 0.30%. The uniform elongation is a measure of fabricability of the steel.

Thus, in the steel according to the invention low temperature toughness and fabricablity of the steel can be concurrently enhanced by adding Cu in an amount of from 0.02% and less than 0.30%. By the way, adverse effects of Cu on high temperature properties of the steel (e.g. deterioration of hot workability) hardly appear by addition of such an order of Cu.

O: Since O (oxygen) adversely affects weldability of the steel, the lowest possible O content is preferred. However, the lower the O content the more expensive manufacturing costs. With the steel according to the invention the O content can readily be reduced by addition of Al and Si. For a purpose of satisfactory weldability of the steel we now set the upper limit for O as 0.012%.

Ti and Al: With the steel according to the invention each of Ti and Al is tolerable up to 0.10%, irrespective of intentional addition and non-addition. Ti enhances an r-value (Lankford value) of the steel on one hand thereby improving fabricability of the steel, as known in the art. However, on the other hand, Ti forms TiN which not only lowers a production yield of steel sheet due to generation of surface defects, but also deteriorates weldability of the sheet. Particularly, if TiN is formed during welding steps for making pipes and/or for assembling the pipes in the fabrication of automobile exhaust gas manifolds, the TiN adversely affects subsequent severe fabrication steps. For these reasons, the Ti content of the steel according to the invention should be controlled up to 0.10%, and preferably maximum 0.05%. An amount of Ti of this order is tolerable as impurities.

Al is useful as a deoxygenating agent to remove oxygen at the time a steel if melted. Since oxygen remaining in the steel adversely affects weldability of the steel, deoxigenation with Al is advantageous. With the steel according to the invention which contains Si, the deoxygenation with Al is not necessarily required, because the Si acts as a deoxygenating agent. Moreover, if an excessive amount of is contained in the steel, an increased amount of Al-containing oxides may be formed at the time the steel is welded and deteriorate weldability of the steel. Accordingly, the Al content of the steel according to the invention should be controlled up to 0.05%. An amount of Al of this order is tolerable as impurities.

Other impurites coming into the steel upon manufacture thereof include P, S and Ni. Since these elements provide no useful functions the less the better. Maximum 0.040% P, maximum 0.008% S and maximum 0.50% of Ni do not provide appreciable adverse effect. Accordingly, up to the respectively indicated maximum orders of these elements are tolerable.

Further, it is important for a purpose of the invention to mutually adjust Mn and Si so that the following relation (1):

$$0.7 \leqq Mn/Si \leqq 1.5 \quad (1)$$

may be satisfied, When this relation (1) is satisfied, the steel will exhibit an oxidation weight gain of not more than 0.4 $kg/m^2$ and an amount of scale which has spalled of not more than 0.02 $kg/m^2$ after subjected to a continuous heating in atmospheric air at a temperature of 1000° C. for a period of 100 hours. FIG. 1 depicts that an oxidation weight gain much lower than the above described value 0.4 $kg/m^2$ and an amount of scale which has spalled of much lower than the above described value 0.02 $kg/m^2$ can be achieved by opimization of the Mn/Si ratio.

Furthermore, it is important for a purpose of the invention that the alloying elements are mutually adjusted so that in addition to the relation (1) the relations (2), (3) and (4) are satisfied, While this is demonstrated in Example, brief explanation will be given below.

When Nb and Si are mutually adjucted so that the relation (2):

$$1.4 \leqq Nb+1.2Si \leqq 2.0 \quad (2)$$

may be satisfied, the steel will exhibit an excellent high temperature fatigue property. This effect can be realized when the amount of Nb+1.2 Si is at least 1.4%. However, if either Nb or Si is excessively present, fabricability of the steel is deteriolated. Accordingly, the amount of Nb+1.2 Si should be controlled not more than 2.0%.

When the alloying elements are mutually adjusted so that the relation (3):

$$1221.6(c+N)-55.1Si+65,7Mn-8.7Cr-99.5Ti-40.4Nb+1.1Cu+54 \leqq 0 \quad (3)$$

may be satisfied, the steel will not form austenite at a temperature up to 1000° C. In a case of an automobile exhaust manifold, it is necessary to consider a service temperature of up to 1000° C. If an austenite phase is formed during service, abnormal oxidation of the steel starts at that position where the austenite phase has been formed. The abnormal oxidation of the steel can be prevented by balancing the alloying elements so that the relation (3) may be satisfied.

It has been found thst when a total amount of Cr, Mn and Si is adjusted so that the following relation (4):

$$Cr+Mn+Si \geqq 14.7 \quad (4)$$

may be satisfied, the steel will have high temperature oxidation resistance required for automobile exhaust manifolds. This will now be explained based on test results.

An effect of the total amount of Cr+Mn+Si content on the high temperature oxidation resistance of the steel was examined about ferritice stainless steels having a basic composition of 11.0–15.5% Cr, 0.8–1.2% Si, 0.7–1.5% Mn, 0.5% Nb, 0.1% Cu with varied Cr, Si and Mn. Test thickness of 2.0 mm of each steel to be tested were subjected to a continuous heating in atmospheric air at a temperature of 930° C. or 950° C. for a period of 200 hours. At the end of the period, oxidation weight gain of each test piece per unit area was determined. Results are plotted against the total amount of Cr+Mn+Si content and shown in FIGS. 4 and 5, which relate to continuous heatings at temperatures of 930° C. and 950° C., respectivcely.

Figure 4:
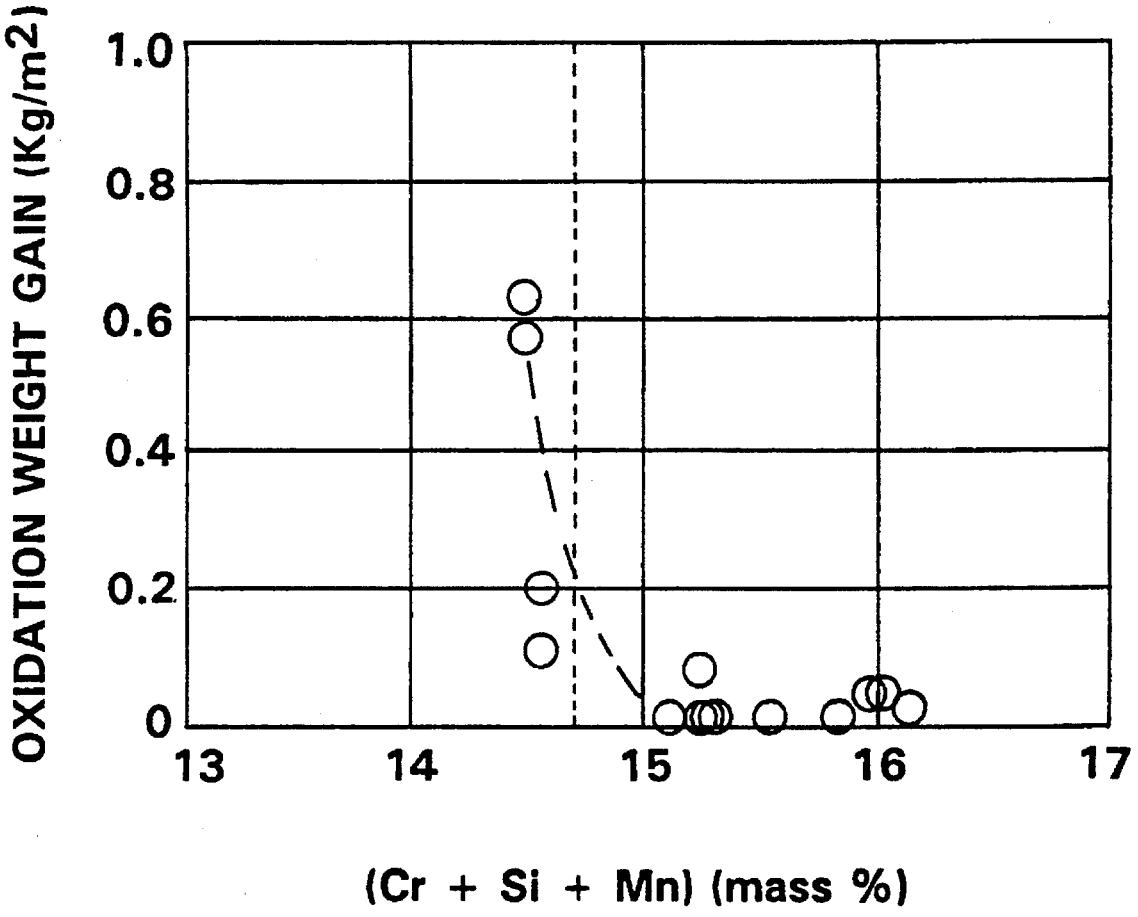
FIG. 4 depicts the oxidation weight gain of the steel after the steel has been continuously heated at a temperature of 930° C. in atmospheric air for a period of 200 hours plotted against the total content of (Cr+Si+Mn) in the steel.
Figure 5:
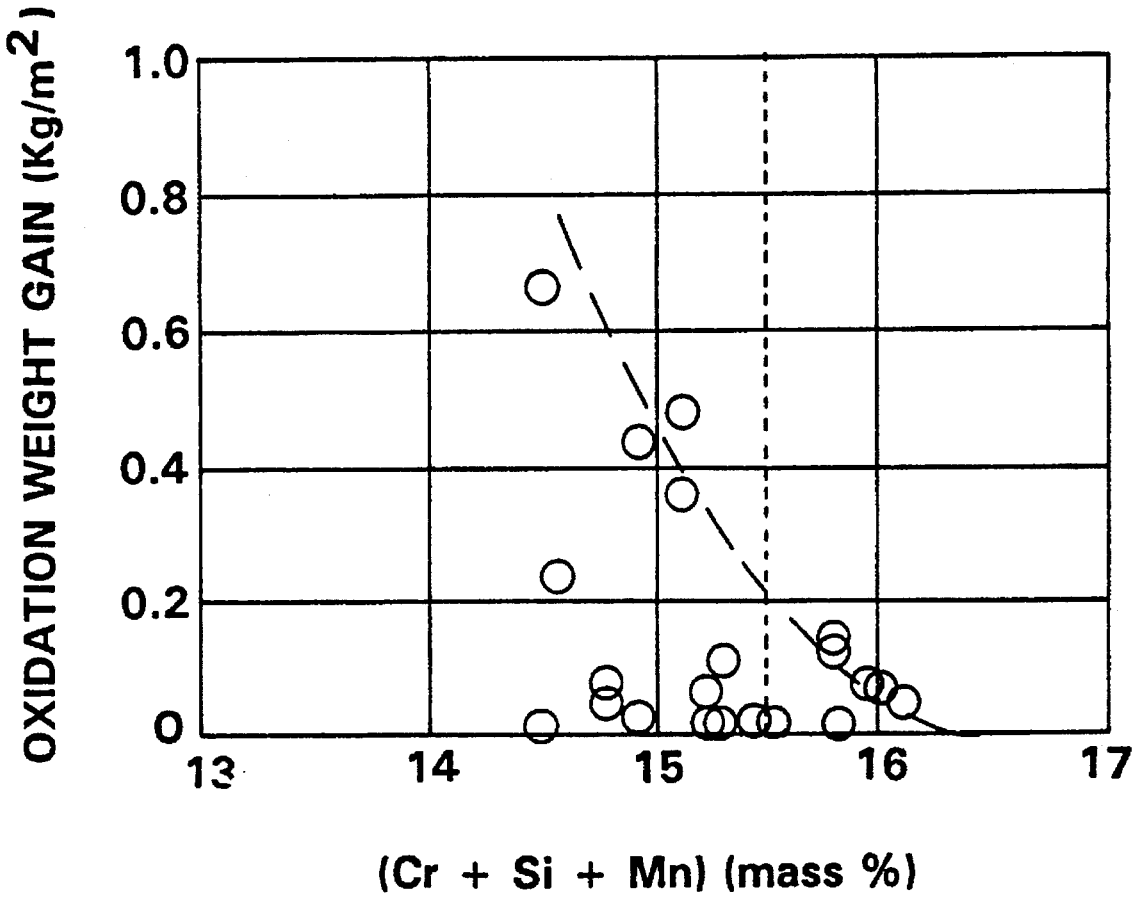
FIG. 5 depicts the oxidation weight gain of the steel after the steel has been continuously heated at a temperature of 950° C. in atmospheric air for a period of 200 hours plotted against the total content of (Cr+Si+Mn) in the steel.

FIGS. 4 and 5 revealed that the oxidation weight gain which may be a measure of high temperature oxidation resistance of the steel greatly depends upon the total amount of Cr+Mn+Si in the steel. Letting a level of oxidation weight gain which might cause abnormal oxidation of the steel be at least 0.2 $Kg/m^2$ it can understood from FIGS. 4 and 5 that occurreance of abnormal oxidation in continuous heatings for 200 hours at 930° C. and 950° C. can be suprressed if the total amount of Cr+Mn+ Si content is at least 14.7 mass % respectively. Thus, from the test results we have obtained information that if the following relations (4) and (4)':

$$Cr+Mn+Si \geqq 14.7 \quad (4)$$

$$Cr+Mn+Si \geqq 15.5 \quad (4)'$$

are respectively satisfied, the steel exhibits excellent high temperature oxidation resistance at tempratures of 930° C. and 950° C., respectivcely.

The ferritic stainless steel according to the invention having the alloying elements induvidually and mutually adjusted as described herein is excellent not only in high temperature oxidation resistance and adhesion of scale, but also in low temperature toughness and fabricability, as well as in high temperature strengh and high temperature fatigue resistance. Advantageously, the manufacturing cost of the steel according to the invention is less expensive than that of 18 Cr stainless steels. While exhaust gas piping generally includes weld parts, the steel according to the invention exhibits good thermal fatigue resistance of weld parts.

The steel according to the invention having a combination of such good properties is a material suitable for an automobile exhaust manifold which is directly connected to an automobile engine and subjected to a high temperature. The automobile exhaust manifold can be prepared by suitably fabricating and welding sheets which have been pressed or pipes which have been formed by high frequency welding to a desired shape and dimensions. During service it is exposed to an exhaust gas of a high temperature, experiences severe vibration and subjected to repeated cycles of heating and cooling. The steel according to the invention is more durable and less expensive than materials which have heretofore been used in such an application, as demonstrated in Example hereinafter.

The inexpensive ferritic stainless steel according to the invention is useful for not only an automobile exhaust manifold but also members which are used at high temperatures of from 700° C. to 950° C. and required to have high temperature oxidation resistance and scale adhesion, including, for example, an outside cylinder of a metallic converter mounted on an exhaust passage of an automobile engine and an exhaust gas piping of a thermal power generation system.

The invention will now be specifically illustrated by the following Example.

Example

Tables 1 through 3 show the composition (mass % of alloying elements) of the tested steels. Steels F01 through F10, E01 through E08, G01 through G07 and A01 through A7 are steels according to the invention, while Steels F11 through F17, E09 and E10 as well as G08 are control steels outside the scope of the invention. Each steel was melted, forged, hot rolled to a thickness of 4.5 mm, intermediately annealed at a temperature of 1050° C., cold rolled to a thickness of 2.0 mm and annealed at a temperature of 1050° C. Test pieces prepared from the cold rolled and annealed materials were subjected to various tests. For testing thermal stress properties pipes prepared by high frequency welding of cold rolled and annealed sheets of Steels F01 and F14were used as test pieces.

Test pieces having a length of 35 mm, a width of 25 mm and a thickness of 2.0 mm cut from the cold rolled and annealed sheet of each steel shown in Tables 1 through 3 were continuously heated in air at the indicated temperature for the indicated period of time, for example, at 900° C. and 1000° C. for 100 hours. At the end of the period, oxidation weight gain and amount of scale which had spalled per unit area were determined. Results are shown in Tables 4 and 5.

Incidentally the amount of scale which had spalled was determined by collecting oxide scale which had naturally spalled when the heated test piece had been allowed to cool, measuring the weight of the collected scale and calculating the weight per unit area. Test pieces which underwent abnormal oxidation during the test are shown by a mark x in Table 5 and were covered with wen-shaped oxide. With such test pieces, we consider that oxidation resistance cannot be properly estimated in terms of amount of scale which has spalled.

Typical steels according to the invention and those of control steels were tested for low temperature toughness and fabricability as well as high temperature tensile and fatigue properties. Results are shown in Table 6.

Low temperature toughness was estimated in terms of fracture appearance transition point. In the test to determine fracture appearance transition temperature of a given steel, V-notched impact test pieces having a thickness of 2.0 mm in accordance with JIS Z 2202 prepared from the steel were subjected to an impact test in accordance with JIS Z 2241 (Charpy impact test) at various temperatures within the range between −75° C. and 50° C. and the lowest temperature at which 50% of the test pieces underwent ductile fracture was determined and is referred to herein as the fracture appearance transition point of the tested steel.

Fabricability was examined by tensile test and bend test. In the tensile test, test pieces in accordance with JIS Z 2201 No. 13 B of a steel to be tested were subjected to a tensile test in accordance with JIS Z 2241 to determine total elongation and uniform elongation. In the bend test, test pieces in accordance with JIS Z 2204 No. 1 of a steel to be tested were subjected to a press bend test in accordance with JIS Z 2248 to determine a bend angle at which the test piece cracked.

High temperature tensile properties were estimated in terms of 0.2% proof stress determined by a high temperature tensile test in accordance with JIS G 0567 at tempertures of 700° C. and 900° C. High temperature fatigue property was tested by a method of plane bending fstigue testing of metal plates in accordance with JIS Z 2275. In the test, a test piece (plane) of a steel to be tested was repeatedly bent under conditions including temperature of 600° C., maximum stress of 180 $N/mm^2$ average stress of 0 $N/mm^2$ and a rate of benting repetition of 40 Hz and another test piece under conditions including temperature of 900° C., maximum stress of 30 $N/mm^2$, average stress of 0 $N/mm^2$ and a rate of benting repetition of 60 Hz to determine a number of repeated bending until failure. In a case wherein this number of repeated bending until failure was more than $10^7$, the steel was estimated as having good high temperature fatigue property.

Table 7 shows results of a thermal stress or fatigue test. In the test pipes having a diameter of 42.7 mm prepared by high frequency welding of cold rolled-and annealed sheets of Steels F01 and F14 were used as test pieces. The pipe was repeatedly subjected to cycles of heating and cooling under a stress, each cycle comprising heating the test piece to an upper limit temperature of 900° C. and cooling to a temperature of a lower limit temperature of 200° C. wherein rates of heating and cooling were 3° C./min. and the pipe was held at the upper and lower limit temperatures for 0.5 min. A percent constraint of the added stress (that is a ratio of added strain to an amount free thermal expansion of the material) was 50%. Repeated cycles to failure (that is a number of repeated cycles at the time the maximum tensile stress of the pipe had been lowered to 75% of the initial tensile stress of the pipe) was determined. A state of adhesion of scale to the steel was estimated by visual observation.

TABLE 1

| | Steel No. | C | Si | Mn | Cr | Nb | Cu | Ni | N | Al | Ti | O | G Note (1) | Mn/Si | Nb − 8 (C + N) | Nb + 1.2 Si | Cr + Mn + Si |
|---|---|---|---|---|---|---|---|---|---|---|---|---|---|---|---|---|---|
| I | F01 | 0.008 | 1.07 | 1.06 | 13.23 | 0.52 | 0.04 | 0.14 | 0.009 | 0.007 | 0.02 | 0.011 | −52.6 | 0.99 | 0.384 | 1.804 | 15.36 |
| (1) | F02 | 0.009 | 0.82 | 0.99 | 12.88 | 0.45 | 0.03 | 0.12 | 0.008 | 0.006 | 0.03 | 0.009 | −38.6 | 1.21 | 0.314 | 1.434 | 14.69 |
| | F03 | 0.013 | 1.17 | 1.02 | 13.06 | 0.51 | 0.02 | 0.11 | 0.007 | 0.007 | 0.01 | 0.008 | −54.2 | 0.87 | 0.350 | 1.914 | 15.25 |
| | F04 | 0.006 | 0.96 | 0.72 | 13.15 | 0.53 | 0.03 | 0.10 | 0.011 | 0.009 | 0.01 | 0.009 | −67.6 | 0.75 | 0.394 | 1.682 | 14.83 |
| | F05 | 0.009 | 1.03 | 1.46 | 13.46 | 0.55 | 0.05 | 0.08 | 0.010 | 0.010 | 0.01 | 0.010 | −23.9 | 1.42 | 0.398 | 1.786 | 15.95 |
| | F06 | 0.012 | 0.85 | 0.65 | 14.56 | 0.48 | 0.04 | 0.09 | 0.013 | 0.016 | 0.01 | 0.007 | −66.6 | 0.76 | 0.280 | 1.500 | 16.06 |
| | F07 | 0.016 | 1.15 | 1.58 | 12.85 | 0.44 | 0.15 | 0.12 | 0.009 | 0.008 | 0.03 | 0.011 | −7.4 | 1.37 | 0.240 | 1.820 | 15.58 |
| | F08 | 0.009 | 0.94 | 0.95 | 11.25 | 0.26 | 0.18 | 0.16 | 0.002 | 0.012 | 0.05 | 0.003 | −37.5 | 1.01 | 0.188 | 1.388 | 13.14 |
| | F09 | 0.026 | 1.16 | 1.44 | 14.76 | 0.75 | 0.01 | 0.11 | 0.026 | 0.047 | 0.08 | 0.011 | −44.9 | 0.82 | 0.296 | 1.752 | 14.79 |
| | F10 | 0.011 | 1.06 | 0.98 | 12.75 | 0.48 | 0.27 | 0.13 | 0.012 | 0.006 | 0.03 | 0.008 | −18.4 | 1.24 | 0.334 | 2.142 | 17.36 |
| I | E01 | 0.013 | 0.96 | 0.98 | 13.18 | 0.45 | 0.20 | 0.01 | 0.013 | 0.005 | 0.01 | 0.007 | −36.4 | 1.02 | 0.242 | 1.602 | 15.12 |
| (2) | E04 | 0.025 | 0.89 | 1.01 | 14.62 | 0.77 | 0.06 | 0.86 | 0.026 | 0.046 | 0.08 | 0.004 | −32.6 | 1.13 | 0.362 | 1.838 | 16.52 |
| | E05 | 0.012 | 0.82 | 0.96 | 13.25 | 0.47 | 0.15 | 0.02 | 0.010 | 0.009 | 0.02 | 0.011 | −37.3 | 1.17 | 0.294 | 1.454 | 15.03 |
| | E06 | 0.009 | 1.19 | 1.02 | 13.08 | 0.53 | 0.16 | 0.11 | 0.010 | 0.006 | 0.02 | 0.008 | −58.4 | 0.86 | 0.378 | 1.958 | 15.29 |
| | E07 | 0.010 | 1.09 | 0.81 | 14.80 | 0.44 | 0.08 | 0.18 | 0.009 | 0.007 | 0.05 | 0.009 | −81.0 | 0.74 | 0.288 | 1.748 | 16.70 |
| | E08 | 0.008 | 0.95 | 1.46 | 11.21 | 0.41 | 0.06 | 0.26 | 0.008 | 0.010 | 0.06 | 0.005 | −2.8 | 1.53 | 0.282 | 1.550 | 13.62 |

Note (1): G = 1221.6 × (% C + % N) − 55.1 × (% Si) + 65.7 × (% Mn) − 8.7 × (% Cr) − 99.5 × (% Ti) − 40.4 × (% Nb) + 1.1 × (% Cu) + 54
Note (2): content of each element is in mass %.
I(1), I(2): Steels according to the invention.

TABLE 2

(Cont'd from Table 1)

| | Steel No. | C | Si | Mn | Cr | Nb | Cu | Ni | N | Al | Ti | O | G Note (1) | Mn/Si | Nb − 8 (C + N) | Nb + 1.2 Si | Cr + Mn + Si |
|---|---|---|---|---|---|---|---|---|---|---|---|---|---|---|---|---|---|
| I | G01 | 0.011 | 0.81 | 0.84 | 13.59 | 0.45 | 0.10 | 0.11 | 0.008 | 0.010 | 0.02 | 0.004 | −50.4 | 1.04 | 0.298 | 1.422 | 15.24 |
| (3) | G02 | 0.006 | 0.83 | 0.81 | 14.01 | 0.48 | 0.12 | 0.12 | 0.008 | 0.010 | 0.02 | 0.004 | −64.6 | 0.98 | 0.368 | 1.476 | 15.65 |
| | G03 | 0.007 | 0.82 | 0.80 | 15.47 | 0.53 | 0.11 | 0.11 | 0.007 | 0.011 | 0.01 | 0.006 | −78.4 | 0.98 | 0.418 | 1.514 | 17.09 |
| | G04 | 0.006 | 0.83 | 0.62 | 13.58 | 0.51 | 0.21 | 0.10 | 0.009 | 0.009 | 0.01 | 0.006 | −72.2 | 0.75 | 0.390 | 1.506 | 15.03 |
| | G05 | 0.009 | 0.82 | 0.61 | 14.16 | 0.52 | 0.25 | 0.13 | 0.009 | 0.009 | 0.04 | 0.006 | −77.0 | 0.74 | 0.376 | 1.504 | 15.59 |
| | G06 | 0.010 | 1.06 | 1.08 | 14.06 | 0.51 | 0.27 | 0.11 | 0.009 | 0.008 | 0.03 | 0.006 | −55.9 | 1.02 | 0.358 | 1.782 | 16.20 |
| | G07 | 0.011 | 1.16 | 1.46 | 14.43 | 0.50 | 0.09 | 0.11 | 0.006 | 0.010 | 0.09 | 0.008 | −38.4 | 1.25 | 0.364 | 1.892 | 16.65 |
| I | A1 | 0.006 | 0.83 | 0.81 | 14.01 | 0.48 | 0.12 | 0.12 | 0.008 | 0.002 | 0.01 | 0.001 | −63.6 | 0.98 | 0.368 | 1.476 | 15.65 |
| (4) | A2 | 0.008 | 0.99 | 0.96 | 13.80 | 0.50 | 0.09 | 0.10 | 0.009 | 0.010 | 0.01 | 0.003 | −57.9 | 0.97 | 0.364 | 1.688 | 15.75 |
| | A3 | 0.006 | 0.91 | 0.98 | 13.60 | 0.49 | 0.11 | 0.13 | 0.009 | 0.002 | 0.01 | 0.002 | −52.4 | 1.08 | 0.370 | 1.218 | 15.49 |
| | A4 | 0.008 | 1.00 | 1.03 | 14.09 | 0.52 | 0.10 | 0.14 | 0.008 | 0.010 | 0.01 | 0.001 | −58.4 | 1.03 | 0.392 | 1.520 | 16.12 |
| | A5 | 0.009 | 0.97 | 1.04 | 14.09 | 0.60 | 0.11 | 0.16 | 0.009 | 0.010 | 0.01 | 0.002 | −56.8 | 1.07 | 0.456 | 1.764 | 16.10 |
| | A6 | 0.013 | 0.94 | 0.94 | 14.04 | 0.54 | 0.20 | 0.16 | 0.009 | 0.010 | 0.01 | 0.003 | −53.9 | 1.00 | 0.364 | 1.668 | 15.92 |
| | A7 | 0.010 | 0.81 | 0.83 | 13.60 | 0.45 | 0.10 | 0.11 | 0.008 | 0.010 | 0.01 | 0.002 | −51.5 | 1.02 | 0.306 | 1.422 | 15.24 |

Note (1): G = 1221.6 × (% C + % N) − 55.1 × (% Si) + 65.7 × (% Mn) − 8.7 × (% Cr) − 99.5 × (% Ti) − 40.4 × (% Nb) + 1.1 × (% Cu) + 54
Note (2): Content of each element is in mass %.
I(3), I(4): Steels according to the invention.

TABLE 3

(Cont'd from Table 1)

| | Steel No. | C | Si | Mn | Cr | Nb | Cu | Ni | N | Al | Ti | O | G Note (1) | Mn/Si | Nb − 8 (C + N) | Nb + 1.2 Si | Cr + Mn + Si |
|---|---|---|---|---|---|---|---|---|---|---|---|---|---|---|---|---|---|
| C | F11 | 0.009 | 1.33 | 0.95 | 13.09 | 0.52 | 0.04 | 0.11 | 0.009 | 0.008 | 0.01 | 0.010 | −70.7 | 0.71 | 0.376 | 2.116 | 15.37 |
| | F12 | 0.006 | 0.75 | 0.95 | 13.26 | 0.56 | 0.06 | 0.09 | 0.009 | 0.007 | 0.02 | 0.009 | −46.5 | 1.27 | 0.440 | 1.460 | 14.96 |

TABLE 3-continued (Cont'd from Table 1)

| Steel No. | C | Si | Mn | Cr | Nb | Cu | Ni | N | Al | Ti | O | G Note (1) | Mn/Si | Nb − 8 (C + N) | Nb + 1.2 Si | Cr + Mn + Si |
|---|---|---|---|---|---|---|---|---|---|---|---|---|---|---|---|---|
| F13 | 0.011 | 1.15 | 1.61 | 13.55 | 0.44 | 0.06 | 0.11 | 0.009 | 0.009 | 0.04 | 0.007 | −20.0 | 1.40 | 0.288 | 1.820 | 16.31 |
| F14 | 0.008 | 0.92 | 0.49 | 12.86 | 0.46 | 0.04 | 0.13 | 0.012 | 0.008 | 0.03 | 0.008 | −73.5 | 0.53 | 0.300 | 1.564 | 14.27 |
| F15 | 0.012 | 0.85 | 1.42 | 13.22 | 0.49 | 0.03 | 0.14 | 0.011 | 0.006 | 0.03 | 0.006 | −9.2 | 1.67 | 0.306 | 1.510 | 15.49 |
| F16 | 0.009 | 1.16 | 0.68 | 13.17 | 0.51 | 0.01 | 0.10 | 0.010 | 0.002 | 0.02 | 0.011 | −79.2 | 0.59 | 0.358 | 1.902 | 15.01 |
| F17 | 0.016 | 0.96 | 1.33 | 11.59 | 0.39 | 0.01 | 0.15 | 0.014 | 0.009 | 0.01 | 0.009 | 8.9 | 1.39 | 0.142 | 1.542 | 13.88 |
| E09 | 0.012 | 1.16 | 0.94 | 13.14 | 0.48 | 0.01 | 0.01 | 0.009 | 0.011 | 0.05 | 0.006 | −61.2 | 0.81 | 0.312 | 1.872 | 15.24 |
| E10 | 0.014 | 0.96 | 1.02 | 13.28 | 0.45 | 0.95 | 0.15 | 0.010 | 0.012 | 0.03 | 0.009 | −38.2 | 1.06 | 0.258 | 1.602 | 15.26 |
| G08 | 0.020 | 0.50 | 0.38 | 11.34 | 0.30 | 0.22 | 0.41 | 0.015 | 0.022 | 0.25 | 0.013 | −41.0 | 0.76 | 0.020 | 0.900 | 12.22 |

Note (1): G = 1221.6 × (% C + % N) − 55.1 × (% Si) + 65.7 × (% Mn) − 8.7 × (% Cr) − 99.5 × (% Ti) − 40.4 × (% Nb) + 1.1 × (% Cu) + 54
Note (2): Content of each element is in mass %.
C: Control steels

TABLE 4

| | | Heating for 100 hrs. | | | | Heating for | |
|---|---|---|---|---|---|---|---|
| | | Oxidation weight gain (kg/m²) | | Amount of scale which spalled (kg/m²) | | 200 hrs Oxidation weight gain (kg/m²) | |
| | No | 900° C. | 1000° C. | 900° C. | 1000° C. | 930° C. | 950° C. |
| I | F01 | 0.004 | 0.086 | ⊙ | ⊙ | 0.095 | 0.195 |
| (1) | F02 | 0.008 | 0.126 | ⊙ | 0.015 | 0.187 | 0.307 |
| | F03 | 0.002 | 0.065 | ⊙ | ⊙ | 0.088 | 0.210 |
| | F04 | 0.005 | 0.076 | ⊙ | 0.008 | 0.105 | 0.257 |
| | F05 | 0.009 | 0.223 | ⊙ | ⊙ | 0.076 | 0.151 |
| | F06 | 0.016 | 0.131 | ⊙ | 0.010 | 0.074 | 0.121 |
| | F07 | 0.001 | 0.021 | ⊙ | ⊙ | 0.085 | 0.137 |
| | F08 | 0.005 | 0.249 | ⊙ | 0.011 | 0.331 | 0.413 |
| | F09 | 0.003 | 0.009 | ⊙ | ⊙ | 0.009 | 0.016 |
| | F10 | 0.007 | 0.076 | ⊙ | 0.012 | 0.029 | 0.251 |
| I | E01 | — | — | — | — | 0.082 | 0.226 |
| (2) | E04 | — | — | — | — | 0.055 | 0.102 |
| | E05 | — | — | — | — | 0.064 | 0.244 |
| | E06 | — | — | — | — | 0.087 | 0.221 |
| | E07 | — | — | — | — | 0.008 | 0.033 |
| | E08 | — | — | — | — | 0.316 | 0.522 |
| I | G01 | 0.007 | 0.195 | ⊙ | ⊙ | 0.088 | 0.251 |
| (3) | G02 | 0.003 | 0.144 | ⊙ | ⊙ | 0.073 | 0.154 |
| | G03 | 0.001 | 0.018 | ⊙ | ⊙ | 0.008 | 0.030 |
| | G04 | 0.008 | 0.188 | ⊙ | ⊙ | 0.121 | 0.336 |
| | G05 | 0.003 | 0.139 | ⊙ | ⊙ | 0.065 | 0.147 |
| | G06 | 0.001 | 0.088 | ⊙ | ⊙ | 0.043 | 0.101 |
| | G07 | 0.001 | 0.054 | ⊙ | ⊙ | 0.021 | 0.040 |

I(1), I(2), I(3): Steels according to the invention.
⊙: No scale spalling.
—: Not tested.

TABLE 5

(Cont'dfrom Table 4)

| | | Heating for 100 hrs. | | | | Heating for | |
|---|---|---|---|---|---|---|---|
| | | Oxidation weight gain (kg/m²) | | Amount of scale which spalled (kg/m²) | | 200 hrs Oxidation weight gain (kg/m²) | |
| | No | 900° C. | 1000° C. | 900° C. | 1000° C. | 930° C. | 950° C. |
| I | A1 | 0.003 | 0.144 | ⊙ | ⊙ | 0.073 | 0.154 |
| (4) | A2 | 0.002 | 0.093 | ⊙ | ⊙ | 0.006 | 0.142 |
| | A3 | 0.002 | 0.121 | ⊙ | ⊙ | 0.004 | 0.203 |
| | A4 | 0.001 | 0.060 | ⊙ | ⊙ | 0.002 | 0.095 |
| | A5 | 0.001 | 0.068 | ⊙ | ⊙ | 0.002 | 0.064 |
| | A6 | 0.011 | 0.072 | ⊙ | ⊙ | 0.002 | 0.086 |
| | A7 | 0.007 | 0.194 | ⊙ | ⊙ | 0.008 | 0.248 |

TABLE 5-continued (Cont'dfrom Table 4)

| | | Heating for 100 hrs. | | | | Heating for | |
|---|---|---|---|---|---|---|---|
| | | Oxidation weight gain (kg/m²) | | Amount of scale which spalled (kg/m²) | | 200 hrs Oxidation weight gain (kg/m²) | |
| | No | 900° C. | 1000° C. | 900° C. | 1000° C. | 930° C. | 950° C. |
| C | F11 | 0.002 | 0.023 | ⊙ | 0.022 | 0.133 | 0.378 |
| | F12 | 0.018 | 0.477 | ⊙ | X | 0.521 | 0.862 |
| | F13 | 0.025 | 0.512 | ⊙ | 0.032 | 0.710 | 1.213 |
| | F14 | 0.015 | 0.095 | 0.012 | X | 0.331 | 0.469 |
| | F15 | 0.016 | 0.812 | ⊙ | X | 0.296 | 1.552 |
| | F16 | 0.019 | 0.186 | 0.016 | 0.0146 | 0.359 | 0.442 |
| | F17 | 0.056 | 0.669 | X | X | 0.859 | 1.952 |
| | G08 | 0.226 | 1.068 | X | X | 1.204 | 2.314 |

I(4): Steels according to the invention.
C: Controls steels.
X: Abnormal oxidation.
⊙: No scale spalling.
—: Not tested.

TABLE 6

| | Steel No. | Fracture appearance transition point (°C.) | Elongation (%) Total | Elongation (%) Uniform | Bend Angle (°)[1] | 0.2% proof-stress (N/mm²) 700° C. | 0.2% proof-stress (N/mm²) 900° C. | Number of repeated bending until failure[2] 600° C. 180 N/mm² | Number of repeated bending until failure[2] 900° C. 30 N/mm² |
|---|---|---|---|---|---|---|---|---|---|
| I | F01 | −40 | 36 | 26 | ⊙ | 109 | 13 | ⊙ | ⊙ |
| | F10 | −50 | 37 | 26 | ⊙ | 119 | 15 | ⊙ | ⊙ |
| | E01 | −50 | 38 | 27 | ⊙ | 116 | 14 | ⊙ | ⊙ |
| | E04 | −40 | 35 | 26 | ⊙ | 106 | 13 | ⊙ | ⊙ |
| | E05 | −50 | 40 | 28 | ⊙ | 110 | 14 | ⊙ | ⊙ |
| | E06 | −50 | 39 | 27 | ⊙ | 112 | 14 | ⊙ | ⊙ |
| | E07 | −40 | 37 | 27 | ⊙ | 105 | 13 | ⊙ | ⊙ |
| | E08 | −40 | 36 | 27 | ⊙ | 108 | 13 | — | — |
| I | A1 | −40 | 37 | 27 | ⊙ | 108 | 13 | — | — |
| | A2 | −40 | 37 | 27 | ⊙ | 110 | 13 | — | — |
| | A3 | −40 | 37 | 27 | ⊙ | 110 | 13 | — | — |
| | A4 | −40 | 37 | 27 | ⊙ | 109 | 13 | — | — |
| | A5 | −40 | 37 | 27 | ⊙ | 115 | 14 | — | — |
| | A6 | −50 | 38 | 27 | ⊙ | 112 | 13 | — | — |
| | A7 | −40 | 37 | 27 | ⊙ | 110 | 13 | — | — |
| C | E09 | −20 | 36 | 25 | ⊙ | 106 | 13 | ⊙ | ⊙ |
| | E10 | 0 | 30 | 20 | ⊙ | 112 | 15 | ⊙ | ⊙ |

Note)
[1]: Bend angle at which the test piece cracks
⊙: No crack even when the test piece has been press bent to the extent that one end touches the other end.

[2]:
⊙: Number of repeated bending before failure is more than $10^7$.
—: Not tested.
I: Steels according to the invention
C: Control steels

TABLE 7

| Steel | Repeated cycles to thermal stress failure[1] | Time taken to the failure (h)[2] | Surface condition |
|---|---|---|---|
| F01 | 850 | 124 | No scale spalling |
| F14 | 780 | 114 | Scale spalled |
| SUS430JIL* | 860 | 126 | Scale spalled |

Note:
Thermal stress test was carried on a pipe having a diameter of 42.7 mm. The pipe was repeatedly subjected to cycles of heating to 900° C., and cooling to 200° C., while adding a stress of 50% coefficient.
[1]Number of repeated cycles at the time the maximum tensile stress of the pipe has been lowered to 75% of the initial tensile stress of the pipe.
[2]Time taken to the thermal stress failure.
*Commercially available SUS430JIL.

As revealed from the results shown in Tables 4 and 5, steels according to the invention have very good high temerature oxidation resistance, as they exhibit an oxidation weight gain of not more than 0.02 kg/m² in the continuous oxidation test at 900° C. and that of not more than 0.4 kg/m²in the continuous oxidation test at 1000° C. At the same time they are excellent in scale adhesion, as they exhibit no scale spalling in the continuous oxidation test at 900° C. and a minimum amount of scale which has spalled as low as not more than 0.02 kg/m² in the continuous oxidation test at 1000° C. As described hereinbefore, Si and Mn effectively serve to suppress oxidation weight gain and scale spalling, respectively, and the properties of the steel according to the invention to suppress oxidation weight gain and scale spalling are governed by the Mn/Si ratio.

Tables 4 and 5 further reveal that steels according to the invention having a total amount of Cr, Mn and Si of at least 14.7 exhibit an oxidation weight gain of not more than 0.2 kg/m² and do not undergo abnormal oxidation when subjected to a continuous heating at 930° C. for 200 hours, and steels having a total amount of Cr, Mn and Si of at least 15.5 exhibit an oxidation weight gain of not more than 0.2 kg/m² and do not undergo abnormal oxidation when subjected to a continuous heating at 950° C. for 200 hours. These steels which do not undergo abnormal oxidation are excellent in scale dhesion.

In contrast to the illustrated steels according to the invention, Control steel G08 which contains Si and Mn in amounts on the same order as in conventional ferritic stainless steels, although its Mn/Si ratio falls within the range prescribed herein, undergoes abnormal oxidation and exhibits considerable scale spalling at a temperature as low as 900° C. This is believed because Control steel G08 contains Si and Mn in amounts less than the lower limits prescribed herein. Control steel F12 which satisfies all the indiviual and mutual requirements prescribed herein for alloying elements except for the Si content undergoes abnormal oxidation in the continuous oxidation test at 1000° C. This is believed because Control steel F12 contains Si in an amoumt less than the lower limit prescribed herein. Control steel F14 having a Si content prescribed herein, which contains Mn in an amount less than the lower limit prescribed herein and in turn has an unduly low Mn/Si ratio, almost all oxide scale formed spalls. This tendency can be well understood by considering corelationship between Mn and Si. For example, Control steel F11 containing Si above the upper limit, Control steel F14 containing Mn below the lower limit and Control steel F16 having an unduly low Mn/Si ratio exibit considerable scale spalling since they do not contain Mn in an amount sufficient to suppress scale spalling and may undergo abnormal oxidation at 1000° C. On the other hand, Control steel F13 containing Mn above the lower limit and Control steel F15 having an unduly high Mn/Si ratio exibit undesirably high oxidation weight gain and undergo abnormal oxidation at 1000° C. although scale spalling is suppressed at 900° C., since they have a relatively high Mn content compared with the Si content.

Control steel F17 which does not satisfy the relation (3) (a value of the left term of the relation is expressed by G in Tables 1 through 3), undergo abnormal oxidation and exhibits an undesirably high oxidation weight gain. This is believed that this steel forms austenite at a temperature ranging from 900° C. to 1000° C. (martensite when observed at ambient temperature) where abnormal oxidation starts. This steel has high temperature oxidation resistance inherantly inferior to that of the steels according to the invention.

As shown in Table 6, Steels E01 through E08 and A1 through A7 according to the invention have a fracture appearance transition point of not higher than −40° C., indicating excellent low temperature toughness. In contrast, Control steels E09 and E10 have a fracture appearance transition point of −20° C. and 0° C., respectively, indicating that low temperature toughness of Control steels is inferior to that of the illustrated steels according to the invention.

Table 6 also reveals that Steels E01 through E08 and A1 through A7 according to the invention have a total elongation of at least 35% and a unuform elongation of more than 25%, indicating good fabricability. In contrast, Control steel E10 has a total elongation of 30% and a unuform elongation of 20%, indicating its fabricability inferior to that of the illustrated steels according to the invention, although Control steel E09 has fairly good fabricability. Incidentally, all the tested steels could be press bent without crack until bend angle reaches 180°.

It is further revealed from Table 6 that the tested steels according to the invention exhibited a 0.2% proof stress of at least 100 N/mm$^2$ at 700° C. and at least 13 N/mm$^2$ at 900° C. in the high temperature tensile test, indicating excellent high temperature tensile property. In the high temperature fatigue test, the tested steels according to the invention were durable more than $10^7$ cycles of repeated bending, indicating excellent high temperature fatigue property.

Table 7 reveals that Steel F01 according to the invention did not undergo scale spalling in both the base metal and weld zones even after subjected to repeated cycles of heating and cooling as well as repeated cycles of tension and compression. A level of thermal stress or fatigue property of the steel according to the invention is nearly the same as that of SUS430JIL having a high content of Cr. However, SUS430JIL underwent scale spalling during the test. Control steel F14 which contained Mn in an amount less than the lower limit prescribed herein and has thermal stress or fatigue property slightly inferior to that of Steel F01, underwent scale spalling dueing the test.

Having so described, the invention provides an inexpensive ferritic stainlesws steel containing a relatively small amount of Cr suitable for a member constituting an exhaust gas pipng of an internal-combusion engine which is used at elevatred temperatures of from 700° C. to 950° C. and where high temperature oxidation resistance and scale adhesion are required, particularly, for an exhaust manifold of an automobile engine and a high temperature exhaust gas piping of a thermal generation system. The material according to the invention is more advantageous than conventional materials which have heretofore been used in the above mentioned applications in both aspects of economy and high temperature properties. Thus, the invention has contributed to the art.

We claim:

1. A ferritic stainless steel excellent in high temperature oxidation resistance and scale adhesion which consists essentially of in mass %, C: up to 0.03%, Si: from 0.80% to 1.20%, Mn: from 0.60% to 1.50%, Cr: from 11.0% to 15.5%, Nb: from 0.20% to 0.80%, Ti: up to 0.1% (inclusive of non-addition), Cu: not less than 0.02% and less than 0.30%, N: up to 0.03%, Al: up to 0.05% (inclusive of non-addition), O: up to 0.012%, the balance being Fe and unavoidable impurities, and wherein the alloying elements are adjusted so that the following relations (1), (2), and (3):

$$0.7 \leqq Mn/Si \leqq 1.5, \quad (1)$$

$$1.4 \leqq Nb + 1.2Si \leqq 2.0 \text{ and} \quad (2)$$

$$1221.6(C + N) - 55.1Si + 65{,}7Mn - 8.7Cr - 99.5Ti - 40.4Nb + 1.1Cu + 54 \leqq 0 \quad (3)$$

are concurrently satisfied, and wherein said steel exhibits an oxidation weight gain of not more than 0.02 kg/m$^2$ and an amount of scale which has spalled of not more than 0.01 kg/m$^2$ after subjected to a continuous heating in atmospheric air at a temperature of 900° C. for a period of 100 hours and said steel exhibits an oxidation weight gain of not more than 0.4 kg/m$^2$ and an amount of scale which has spalled of not more than 0.02 kg/m$^2$ after subjected to a continuous heating in atmospheric air at a temperature of 1000° C. for a period of 100 hours.

2. The ferritic stainless steel excellent in high temperature oxidation resistance and scale adhesion in accordance with claim 1 wherein said steel exhibits an oxidation weight gain of not more than 0.02 kg/m$^2$ and an amount of scale which has spalled of not more than 0.01 kg/m$^2$ after subjected to a continuous heating in atmospheric air at a temperature of 900° C. for a period of 200 hours.

3. A ferritic stainless steel excellent in high temperature oxidation resistance and scale adhesion which consists essentially of in mass %, C: up to 0.03 %, Si: from 0.80% to 1.20%, Mn: from 0.60% to 1.50%, Cr: more than 13.5% and not more than 15.5%, Nb: from 0.20% to 0.80%, Ti: up to 0.1% (inclusive of non-addition), Cu: not less than 0.02% and less than 0.30%, N: up to 0.03%, Al: up to 0.05% (inclusive of non-addition), O: up to 0.012%, the balance being Fe and unavoidable impurities, and wherein the alloying elements are adjusted so that the following relations (1), (2), (3) and (4):

$$0.7 \leqq Mn/Si \leqq 1.5 \quad (1),$$

$$1.4 \leqq Nb + 1.2\,Si \leqq 2.0 \quad (2),$$

$$1221.6(C + N) - 55.1\,Si + 65.7\,Mn - 8.7\,Cr - 99.5\,Ti - 40.4\,Nb + 1.1\,Cu + 54 \leqq 0 \quad (3) \text{ and}$$

-continued

| | |
|---|---|
| $Cr + Mn + Si \geqq 14.7$ | (4) |

are concurrently satisfied, and wherein said steel exhibits an oxidation weight gain of not more than 0.2 $kg/m^2$ and an amount of scale which has spalled of not more than 0.01 $kg/m^2$ after subjected to a continuous heating in atmospheric air at a temperature of 930° C. for a period of 200 hours.

4. A ferritic stainless steel excellent in high temperature oxidation resistance and scale adhesion which consists essentially of in mass %, C: up to 0.03%, Si: from 0.80% to 1.20%, Mn: from 0.60% to 1.50%, Cr: more than 13.5% and not more than 15.5%, Nb: from 0.20% to 0.80%, Ti: up to 0.1% (inclusive of non-addition), Cu: not less than 0.02% and less than 0.30%, N: up to 0.03%, Al: up to 0.05% (inclusive of non-addition), O: up to 0.012%, the balance being Fe and unavoidable impurities, and wherein the alloying elements are adjusted so that the following relations (1), (2), (3) and (4):

| | |
|---|---|
| $0.7 \leqq Mn/Si \leqq 1.5$ | (1), |
| $1.4 \leqq Nb + 1.2\ Si \leqq 2.0$ | (2), |
| $1221.6(C + N) - 55.1\ Si + 65.7\ Mn - 8.7\ Cr - 99.5\ Ti - 40.4\ Nb + 1.1\ Cu + 54 \leqq 0$ | (3) and |
| $Cr + Mn + Si \geqq 15.5$ | (4) |

are concurrently satisfied, and wherein said steel exhibits an oxidation weight gain of not more than 0.2 $kg/m^2$ and an amount of scale which has spalled of not more than 0.01 $kg/m^2$ after subjected to a continuous heating in atmospheric air at a temperature of 950° C. for a period of 200 hours.

5. The ferritic stainless steel excellent in high temperature oxidation resistance and scale adhesion in accordance with claim 1, 2, 3 or 4 wherein the steel is fabricated into a member constituting an exaust gas piping of an internal-combusion engine.

6. The ferritic stainless steel excellent in high temperature oxidation resistance the member constituting an exaust gas piping of an internal-combusion engine is an automobile exhaust manifold.

* * * * *